US011590406B2

(12) United States Patent
Billington et al.

(10) Patent No.: US 11,590,406 B2
(45) Date of Patent: Feb. 28, 2023

(54) MULTI-MODE LOAD ABSORBING SKI BINDING

(71) Applicant: Worcester Polytechnic Institute, Worcester, MA (US)

(72) Inventors: Jacob J. Billington, North Attleboro, MA (US); Jonathan D. Comden, Vestaburg, MI (US); Sean J. Regan, Chelmsford, MA (US); Thomas C. Roberti, Hauppauge, NY (US); Christopher A. Brown, Cazenovia, NY (US)

(73) Assignee: Worcester Polytechnic Institute, Worcester, MA (US)

( * ) Notice: Subject to any disclaimer, the term of this patent is extended or adjusted under 35 U.S.C. 154(b) by 516 days.

(21) Appl. No.: 15/952,451

(22) Filed: Apr. 13, 2018

(65) Prior Publication Data

US 2018/0296902 A1 Oct. 18, 2018

Related U.S. Application Data

(60) Provisional application No. 62/485,151, filed on Apr. 13, 2017.

(51) Int. Cl.

| | |
|---|---|
| ***A63C 5/075*** | (2006.01) |
| ***A63C 9/084*** | (2012.01) |
| ***A63C 9/00*** | (2012.01) |

(52) U.S. Cl.

CPC ..... *A63C 9/0846* (2013.01); *A63C 5/075* (2013.01); *A63C 9/007* (2013.01); *A63C 9/003* (2013.01)

(58) Field of Classification Search

CPC ..... A63C 5/075; A63C 9/007; A63C 17/0046; A63C 9/08585; A63C 9/08578; A43B 13/182

See application file for complete search history.

(56) References Cited

U.S. PATENT DOCUMENTS 2,706,606 A * 4/1955 Allen ..... F16F 15/067 248/578
2,912,212 A * 11/1959 Lowe ..... F16F 15/06 248/573

(Continued)

FOREIGN PATENT DOCUMENTS

CA 2538931 A1 * 9/2006 ..... A43B 5/0427
DE 2607881 A1 * 9/1977 ..... A63C 5/075

(Continued)

OTHER PUBLICATIONS

"Work By Integration"; https://www.rit.edu/studentaffairs/asc/sites/rit.edu.studentaffairs.asc/files/docs/Work%20by%20Itegration_Summer2017.pdf; 2017.*

(Continued)

*Primary Examiner* — Emma K Frick
(74) *Attorney, Agent, or Firm* — Armis IP Law, LLC

(57) ABSTRACT

A ski binding reduces a likelihood of injury to the anterior cruciate ligament (ACL) and the tibia is accomplished by absorption in the binding to limit loads transmitted through the boot-binding interface. Release based on an injury threshold includes a binding response tower attached to the ski and adapted for selective engagement with the ski, such that the binding response tower permits biased vertical and lateral horizontal displacement, prior to a release threshold. The binding is in communication with the boot heel and is adapted for slideable engagement in response to vertical and lateral forces exerted from the boot heel. The binding response tower adapted to disengage, or release upon reaching at least one a predetermined lateral displacement or a predetermined vertical displacement, such as when the boot heel is forced sufficiently sideways or upwards due to skier movement that would tend to cause an ACL injury.

9 Claims, 10 Drawing Sheets

(56) References Cited

U.S. PATENT DOCUMENTS 2,924,419 A * 2/1960 Wells ..... F16F 15/067 267/140.11
3,228,708 A 1/1966 Miller
3,794,338 A * 2/1974 Smolka ..... A63C 9/0845 280/629
3,897,075 A * 7/1975 Cutter ..... A63C 9/08564 280/626
3,921,994 A * 11/1975 Locati ..... A63C 5/02 280/607
4,165,887 A 8/1979 Bunn, Jr.
4,294,460 A 10/1981 Kirsch
4,316,618 A * 2/1982 Sampson ..... A43B 5/0427 280/613
4,401,317 A * 8/1983 Horiuchi ..... A63C 9/0846 280/625
4,408,744 A * 10/1983 Thompson ..... B60N 2/544 248/636
4,565,386 A * 1/1986 Crainich ..... A63C 5/075 280/602
4,596,373 A * 6/1986 Omi ..... F16F 15/02 248/562
4,629,208 A * 12/1986 Gertsch ..... A63C 9/081 280/618
4,902,031 A * 2/1990 Bogner ..... A63C 9/08521 280/625
4,974,867 A * 12/1990 Rullier ..... A63C 5/075 280/607
5,135,250 A * 8/1992 Abondance ..... A63C 5/075 280/617
5,207,448 A * 5/1993 Bonvallet ..... A63C 9/08 280/625
5,566,968 A * 10/1996 Challande ..... A63C 9/08521 280/625
5,669,594 A * 9/1997 Platus ..... F16F 3/026 248/619
5,775,716 A * 7/1998 Harsanyi ..... A63C 5/07 280/602
5,775,717 A * 7/1998 Bobrowicz ..... A63C 5/03 280/11.14
5,820,154 A * 10/1998 Howe ..... A63C 5/07 280/602
6,065,763 A * 5/2000 Adams, Jr. ..... A63C 17/0046 280/11.19
6,158,747 A * 12/2000 Magnani ..... A63C 5/075 280/11.14
6,648,362 B1 * 11/2003 Bunter ..... A63C 9/003 280/602
6,789,806 B2 * 9/2004 Santa Cruz ..... A63C 5/03 280/14.21
6,863,283 B1 * 3/2005 Houston ..... A63C 17/0046 280/11.225
7,134,680 B2 * 11/2006 Emig ..... A63C 5/075 280/602
7,296,805 B2 * 11/2007 Lindemann ..... A63C 10/14 280/14.21
7,494,134 B2 * 2/2009 Mann ..... A63C 5/02 280/11.14
7,758,062 B2 * 7/2010 Klubitschko ..... A63C 9/081 280/613
8,746,729 B2 * 6/2014 Convert ..... A63C 9/08528 280/616
9,033,359 B2 * 5/2015 Favret ..... A63C 5/07 280/613
9,089,763 B2 * 7/2015 Brown ..... A63C 1/24
9,339,719 B2 * 5/2016 Brown ..... A63C 9/084
9,358,447 B2 * 6/2016 Brown ..... A63C 9/0805
9,394,967 B2 * 7/2016 Tu ..... F16F 15/067
9,463,370 B2 11/2016 Howell
9,538,809 B2 * 1/2017 Park ..... A43B 13/182
9,829,063 B2 * 11/2017 Cho ..... F16F 15/067
9,950,242 B2 * 4/2018 Wilson ..... A63C 9/007
9,981,178 B1 * 5/2018 Huynh ..... A63C 5/03
10,232,221 B1 * 3/2019 Grayston ..... A43B 13/184
10,537,156 B2 * 1/2020 Thappeta ..... A43B 13/28
10,718,399 B2 * 7/2020 Martin Hernandez ..... F16F 15/022
2015/0375087 A1 12/2015 Howell
2020/0222787 A1 * 7/2020 Nichols ..... A63C 5/075
2022/0023743 A1 * 1/2022 Brown ..... A63C 5/07

FOREIGN PATENT DOCUMENTS

DE 2747084 A1 * 4/1979 ..... A63C 5/075
DE 9413207 U1 * 12/1994 ..... A63C 5/075
DE 102005004267 A1 * 8/2006 ..... A63C 5/075
EP 0178375 A2 4/1985
FR 2643275 A1 * 8/1990 ..... A63C 5/075
WO WO-2009033307 A1 * 3/2009 ..... A63C 9/003
WO WO 2015/089263 A1 6/2015

OTHER PUBLICATIONS

International Search Report, PCT/US2018/027456, pp. 2, dated Aug. 23, 2018.

* cited by examiner

MULTI-MODE LOAD ABSORBING SKI BINDING

RELATED APPLICATIONS

This application claims the benefit under 35 U.S.C. § 119(e) of U.S. Provisional Patent Application No. 62/485,151, filed Apr. 13, 2017, entitled "SKI BINDING RELEASE," incorporated herein by reference in entirety.

BACKGROUND

Skiing injuries occur when excessive forces beyond human tolerance are transmitted to the skier from the ski. Due to the high-speed nature of the sport, substantial energy is developed by a skier in motion on a steep slope. Ski bindings prevent ski injuries by releasing the skier's leg from rigid communication with the ski when forces deemed to be injurious are applied to the ski, as in a ski fall. Skiers wear specially engageable boots that are adapted to engage a binding attached to the ski, and maintain the boot and thus, the skier's calf and foot, in tight coupling with the ski. Forces transmitted to the legs through the binding system can be injurious, particularly during tight turns, falls, and high-speed maneuvers. Ski bindings are therefore designed to selectively release a skier from the skis by decoupling a ski boot when a predetermined force is achieved. Conventional approaches employ a pivoting toe that pivots the boot from a parallel alignment to the ski to an outward position allowing the boot to freely disengage, such that harmful rotation of the leg relative to the ski is avoided.

SUMMARY

A ski binding reduces a likelihood of injury to the anterior cruciate ligament (ACL) and the tibia is accomplished by absorption in the binding to limit the loads that are transmitted into the leg through the boot-binding interface. A ski binding device for engaging a ski boot heel or toe for release based on a control threshold includes a binding response tower attached to the ski and adapted for selective engagement with the ski, such that the binding response tower permits biased vertical and lateral horizontal displacement of the boot heel and toe with respect to the ski, prior to a release threshold. The binding response tower is in communication with the boot heel and toe and is adapted for slideable engagement in response to vertical and lateral forces exerted from the boot. The binding response tower is adapted to disengage, or release upon reaching at least one a predetermined lateral displacement or a predetermined vertical displacement, such as when the boot heel is forced sufficiently sideways or upwards due to skier movement that would tend to cause an ACL injury.

A containment housing has a biasing force counter to the force from the boot, such the response tower is operable to displace against the biasing counterforce relative to the force from the boot heel, for allowing substantially fixed coupling between the boot and the ski during normal skiing conditions. The biasing counterforce may result from any suitable mechanical or fluidic driven force using at least one of coil springs, pneumatics, hydraulics, cantilever beam springs and cam-spring systems for achieving force displacement behavior. In particular configurations, constant force springs provide a leveling of the force curve to enhance controlled boot displacement.

Configurations herein are based, in part, on the observation that ski bindings and attempt to strike a delicate balance between an inadvertent release and injurious binding retention when a skier's boot remains engaged despite a fall. Often, a threshold force is defined that attempts to differentiate between normal, or "performance" forces and injurious forces. The latter should trigger binding release; the former, retention. Unfortunately, conventional approaches suffer from the shortcoming of unintentional release and over-retention. An international standard purports to define a binding tension setting (din setting) for optimal release. However, high intensity ski competitions, such as the Olympics, demonstrate unfinished runs due to either unintended release or injuries from over-retention. Accordingly, configurations herein substantially overcome the shortcomings of inaccurate release thresholds by defining a multimodal binding that allows for independent vertical and lateral displacement-based force absorption within the performance threshold, i.e. before binding release. Spring biased horizontal and vertical displacement assemblies provide for constant force-biased displacement which permits a controlled level of either force or displacement to determine normal operation. Within this control threshold of force and displacement, the biased members permit skier correction. Control is regained by absorbing forces through displacement before transmitting them to the release mechanism. Only upon attaining a predetermined level of displacement against a constant force spring does binding release occur.

In particular, connected vertical and lateral displacement assemblies allow for forces in either dimension, or a combination, to trigger release. This is particularly effective against Anterior Cruciate Ligament (ACL) injuries. Unlike conventional release patterns, which typically target planar toe rotation and toe binding lateral rotation or pivoting, ACL injuries result from twisting forces to the knee region. In particular combined valgus inward rotation (CVIR) and boot induced anterior drawer (BIAD) involve heel movements and forces.

In further detail, the ski binding device, as disclosed herein includes a vertical displacement assembly coupled between a ski interface and a boot interface, and a lateral displacement assembly coupled between the vertical force assembly and the ski interface. The displacement assemblies operate concurrently and simultaneously for respective dimensions, such that opposed force biasing members disposed in the lateral displacement assembly exert counterforce against lateral forces, and opposed force biasing members disposed in the vertical displacement assembly exert counterforce against vertical forces. The boot interface is adapted to transmit force to the vertical and lateral assemblies for receiving the exerted counterforce based on ski movement transmitted via the ski interface.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Configurations below depict an example heel and toe binding including a displacement absorption approach as disclosed above. A displacement assembly as discussed below is operable in conjunction with a conventional binding exhibiting static release thresholds using conventional springs. While any suitable biasing member (e.g spring, hydraulic, resilient material) may be employed, a constant force spring allows greater displacement, and thus greater recovery potential, while the skier is operating within the control threshold, before injurious forces are attained.

Figure 1:
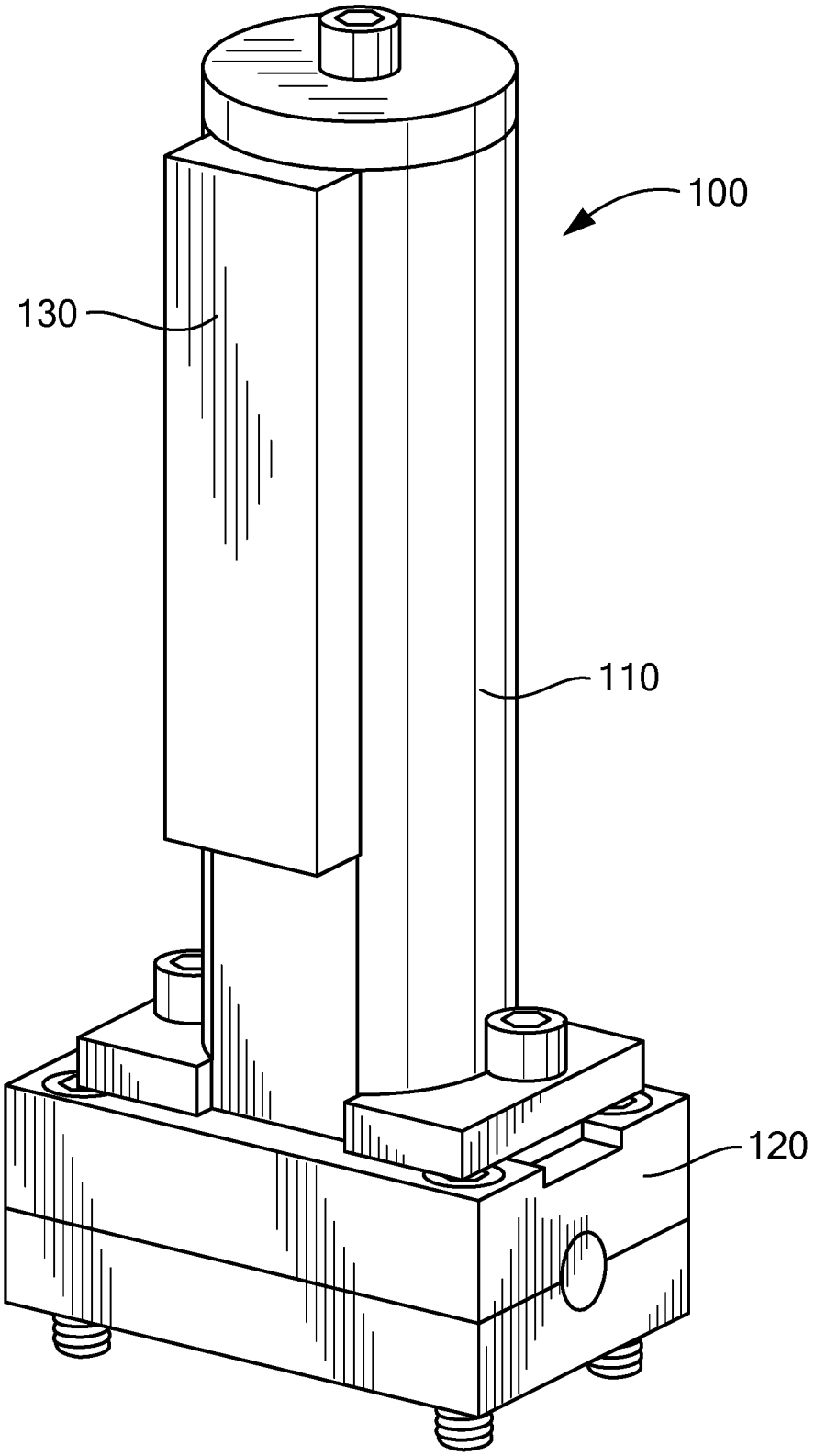
FIG. 1 is a displacement device adapted for the displacement assembly in an unloaded position.

FIG. 1 is a displacement device adapted for the displacement assembly in an unloaded position. Referring to FIG. 1, the displacement device 100 takes the form of a response tower adapted to be positioned and/or integrated between a conventional threshold-based binding and a boot, and may include a plurality of displacement towers, i.e. heel and toe. Each displacement device 100 include a vertical displacement assembly 110 adapted to absorb vertical forces, and a lateral displacement assembly 120 adapted to absorb lateral forces concurrently with the vertical displacement assembly. The displacement assemblies 110, 120 are each adapted to absorb a predetermined displacement against counter forces by travel (displacement) of an interface region 130, shown without boot engagement features for clarity.

Figure 2:
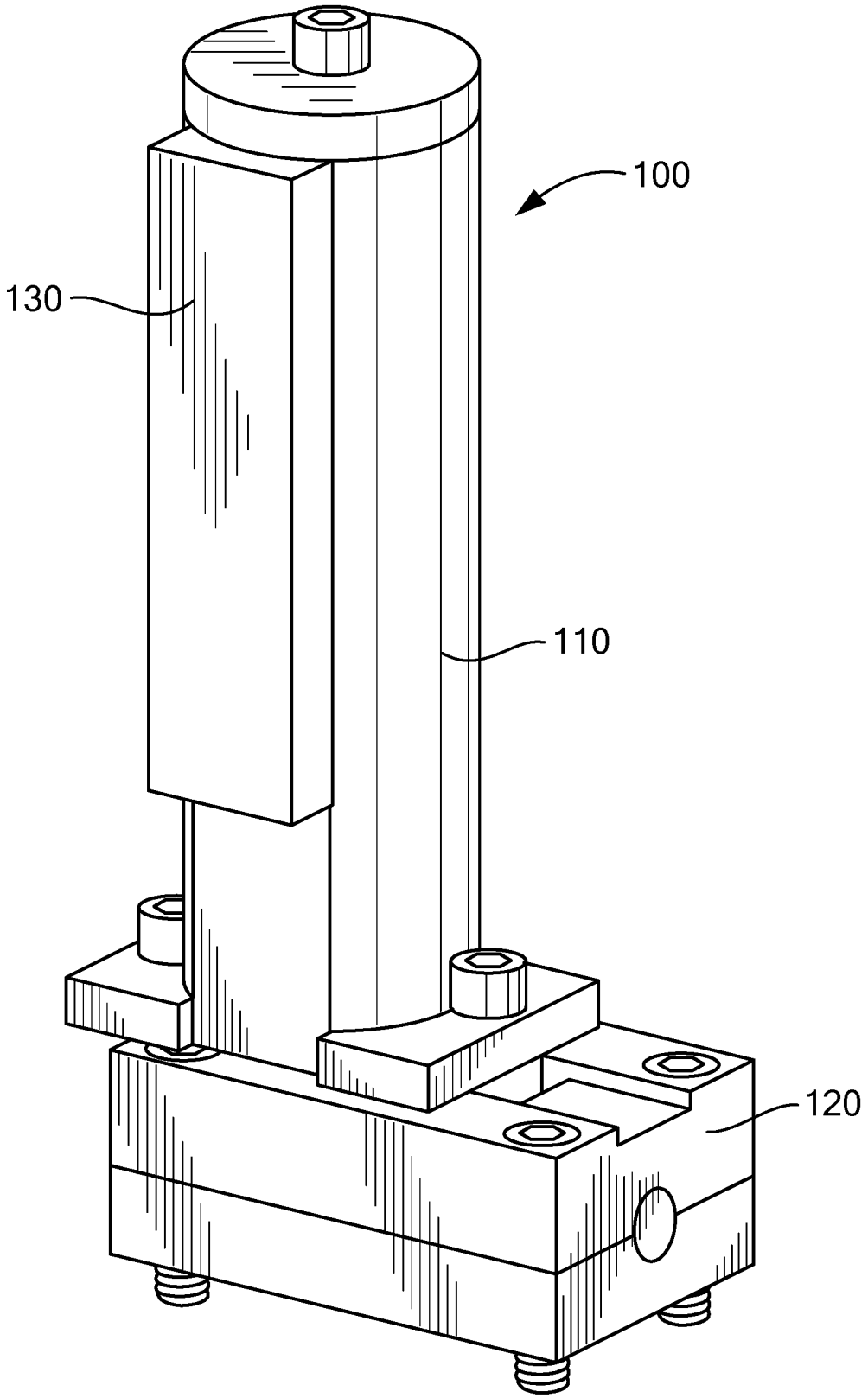
FIG. 2 shows the displacement assembly of FIG. 1 loaded in the vertical and horizontal dimensions.

FIG. 2 shows the displacement assembly of FIG. 1 loaded in the vertical and horizontal dimensions. Referring to FIGS. 1 and 2, the vertical displacement assembly 110 depicts the interface region 130 at an uppermost vertical position. The vertical displacement assembly 110 rests on the horizontal lateral displacement assembly 120, shown in an extreme lateral position.

The load limiting and absorptive ski binding approach disclosed herein further includes a release mechanism adapted to disengage the boot from the boot interface upon the vertical or lateral forces reaching a predetermined injury threshold. The release mechanism receives ski forces once the displacement assemblies 110, 120 are at the extreme travel (displacement) positions as in FIG. 2, at which point continued force would be transmitted to the release mechanism, rather than absorbed. The release mechanism may also take the form of a conventional binding into which the lateral displacement assembly 120 is engaged, discussed further below. The release mechanism is adapted to disengage the boot after a maximum displacement threshold in either the vertical or lateral displacement assemblies is attained.

Figure 3:
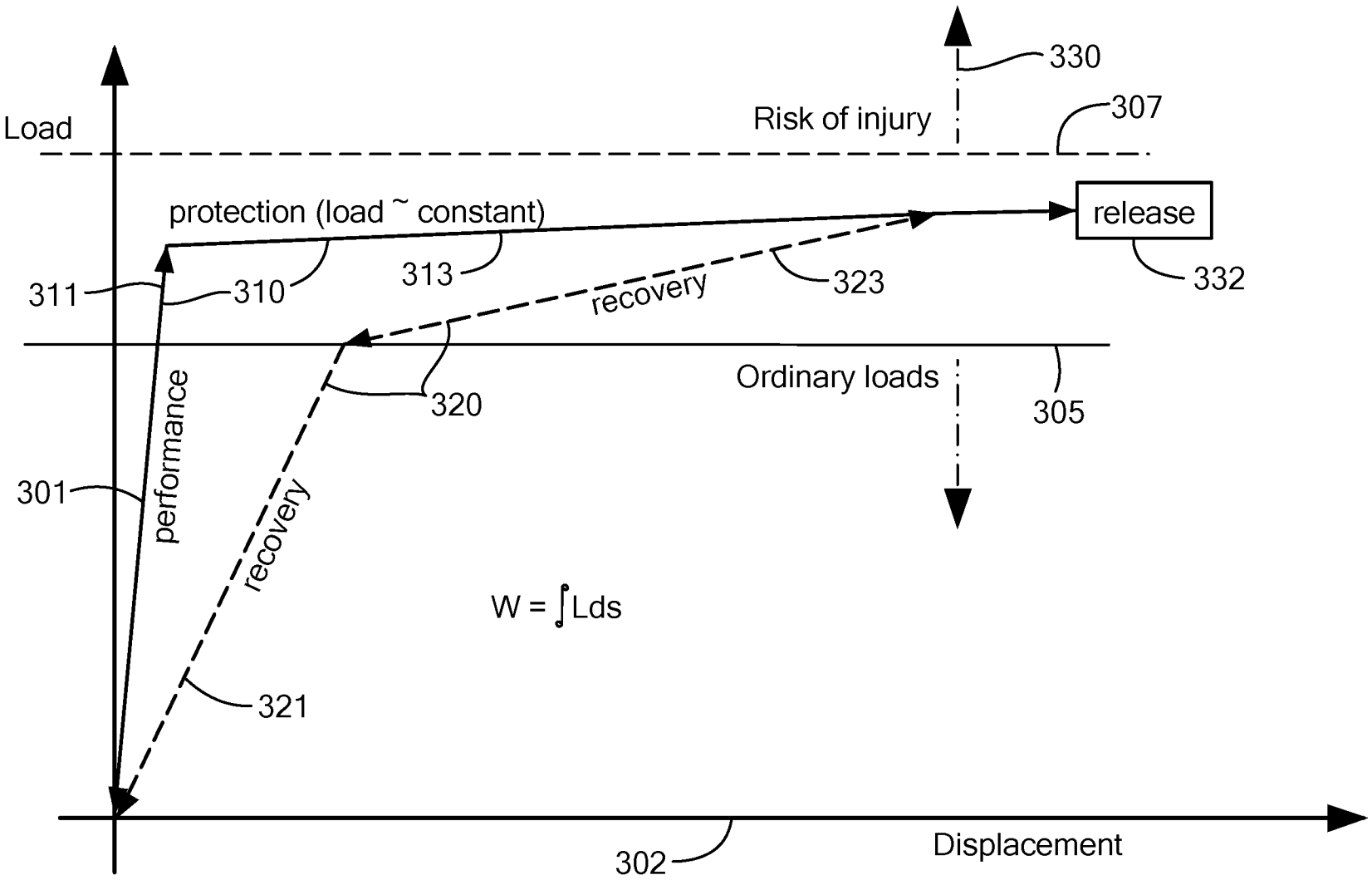
FIG. 3 shows a force curve applicable to the displacement assembly of FIGS. 1-3.

FIG. 3 shows a force curve applicable to the displacement assembly of FIGS. 1-2. Referring to FIG. 3, the determination of work defines the binding displacement permitted before the force threshold reaches release. Conventional approaches release upon attaining a predetermined release force. FIG. 3 illustrates how displacement and absorption of ski induced forces avoids premature release, yet allows timely release when the injury threshold is met. A vertical axis 301 depicts force transmitted from the ski to the binding. A horizontal axis 302 shows displacement, or movement, of the boot absorbed by the displacement assemblies (displacement device 100).

A performance curve 310 shows binding retention and absorption during a high intensity, forceful ski run. A recovery curve 320 shows how forces might be handled in a near fall situation. A control threshold 305 defines the force required to begin displacement in the displacement assembly 110, 120. For forces below this threshold, the displacement assembly holds the boot in rigid, fixed engagement. A release threshold 307 defines force which will cause release. Between is a control range where the displacement assemblies permit biased movement of the boot relative to the binding. Similarly, displacement beyond the displacement threshold 330 will trigger release, 332 due to displacement, even if the load may be below the release threshold 307.

During displacement assembly operation, displacement is defined by work resulting from movement in the displacement assembly against the counter force. This may be a constant force spring or other force exertion in the displacement assembly, disclosed further below. In the performance curve 310 scenario, a skier is exerting continued force against the binding in segment 311, such as a tight turn on a steep slope. Upon crossing the control threshold 305, the displacement assemblies 110, 120 allow displacement, such as the heel sliding out or raising up. The spring in the displacement assembly exerts a constant counterforce, shown by the substantially horizontal segment 313, as displacement increases below the release threshold. Upon attaining the displacement threshold 330, the binding releases.

In recovery scenario 320, a moderate turn is executed at segment 321, and forces increase. Upon attaining the control threshold 305, the displacement assembly mitigates the force, as the slope in segment 323 is less steep. During this segment, relaxation of the force will allow the displacement to subside as the displacement assembly spring biases back. This represents force absorption via displacement, as when a skier is taking a sharp turn, but shortly resumes travel in a straight direction. If not, and displacement increases, release 332 occurs.

Figure 4:
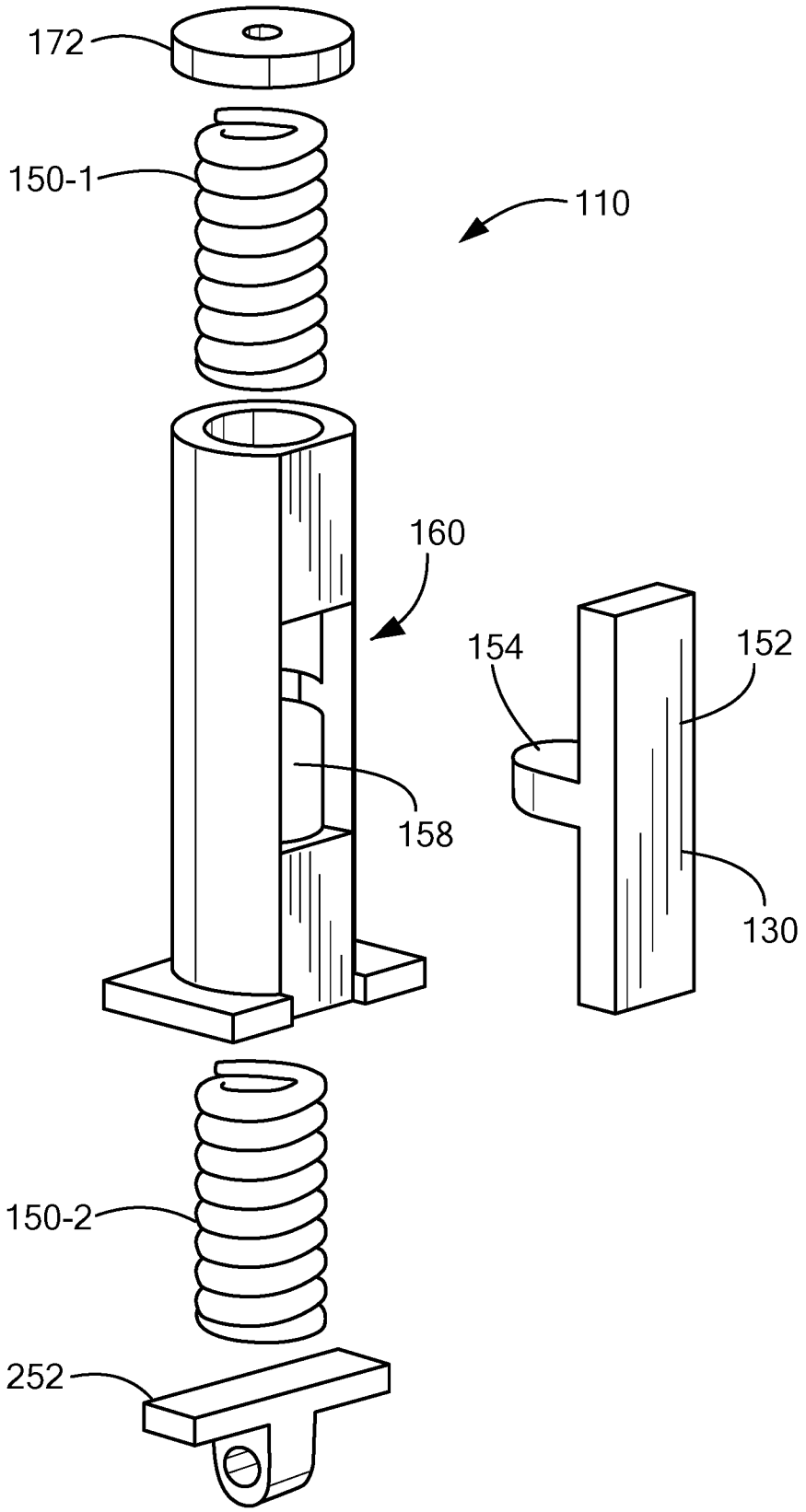
FIG. 4 shows an exploded view of the vertical displacement assembly.
Figure 5:
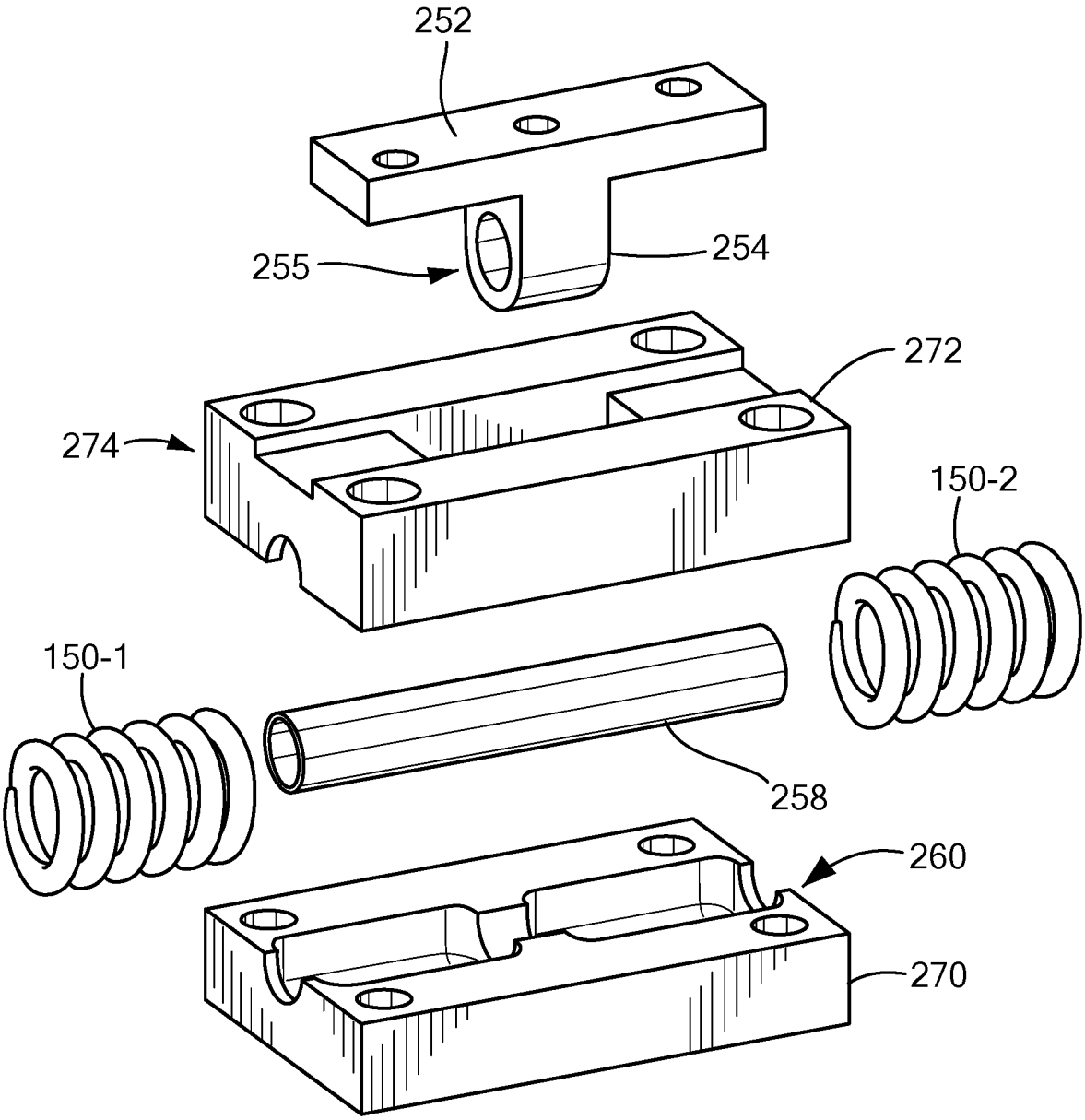
FIG. 5 shows an exploded view of the lateral displacement assembly.

FIG. 4 shows an exploded view of the vertical displacement assembly 110, and FIG. 5 shows an exploded view of the lateral displacement assembly 120. Generally they are attached in a serial or consecutive manner to absorb forces in multiple dimensions. Referring to FIGS. 1-4, in the vertical displacement assembly 110, opposed force biasing members 150-1 . . . 150-2 (150 generally) are disposed in the displacement assembly 110 for exerting counterforce against the ski interface. The displacement assembly 110 includes a moveable slide 152 and linkage protrusion 154 between the opposed force biasing members 150 defining a rear side of the interface region 130. The linkage protrusion 154 is in communication with the force biasing members 150 and is adapted to receive the transmitted forces and transfer the received forces to the force biasing members 150. The degree of force absorption tolerated until the slide 152 reaches maximum travel is defined by the length and tension in the force biasing members 150. Any suitable spring may be employed, however in a particular configuration it is beneficial if the force biasing members exhibit a constant load against the displacement. Such a constant load corresponds to the horizontal or substantially horizontal force curve 313. Thus, constant load may be provided by a constant force spring, discussed further below. Alternatively, the spring may exhibit a greater resistance, or counterforce, to increased slide 152 travel, resulting in a steeper force curve 323.

For resistance to snow, ice and mud that often accompany a ski environment, the moveable slide 152 and interface with force biasing members 150 is enclosed in a cavity 160 adapted from incursion of contamination. A cover 172 encloses the cavity 160. In the cavity 160, the moveable slide 152 includes a rest position defined by an unbiased position between equally displaced force biasing members 150, defining a rest position representing a stationary or static movement (i.e. no turns or acceleration/deceleration). Depending on the size of the cavity 160, the force biasing members 150 have a predetermined counterforce and a maximum displacement in the cavity, following which forces are directly transferred from the ski to the boot, as in an extreme turn or fall, possibly leading to release if the injury threshold is reached.

In FIG. 5, the horizontal complement is shown for the displacement assembly 120. The vertical displacement assembly 110 rests attached to a slide 252 of the lateral displacement assembly 120. This allows concurrent or simultaneous absorption of loads in both dimensions, however other serial arrangements (such as the lateral displacement assembly 120 resting on the vertical 110. As with the vertical, the slide 252 includes a linkage protrusion 254 disposed between the opposed force biasing members 150. An alignment rod 258 extends through the force biasing members 150 and a bore 255 in the linkage protrusion 254; the vertical cavity 160 includes a similar rod 158. A base 270 is adapted for attachment to a ski or conventional injury release binding, and a cover 272 encloses the force biasing members 150 for defining a displacement cavity 260. A channel 274 in the cover permits a slidable linkage with the vertical displacement assembly 110.

Figure 6:
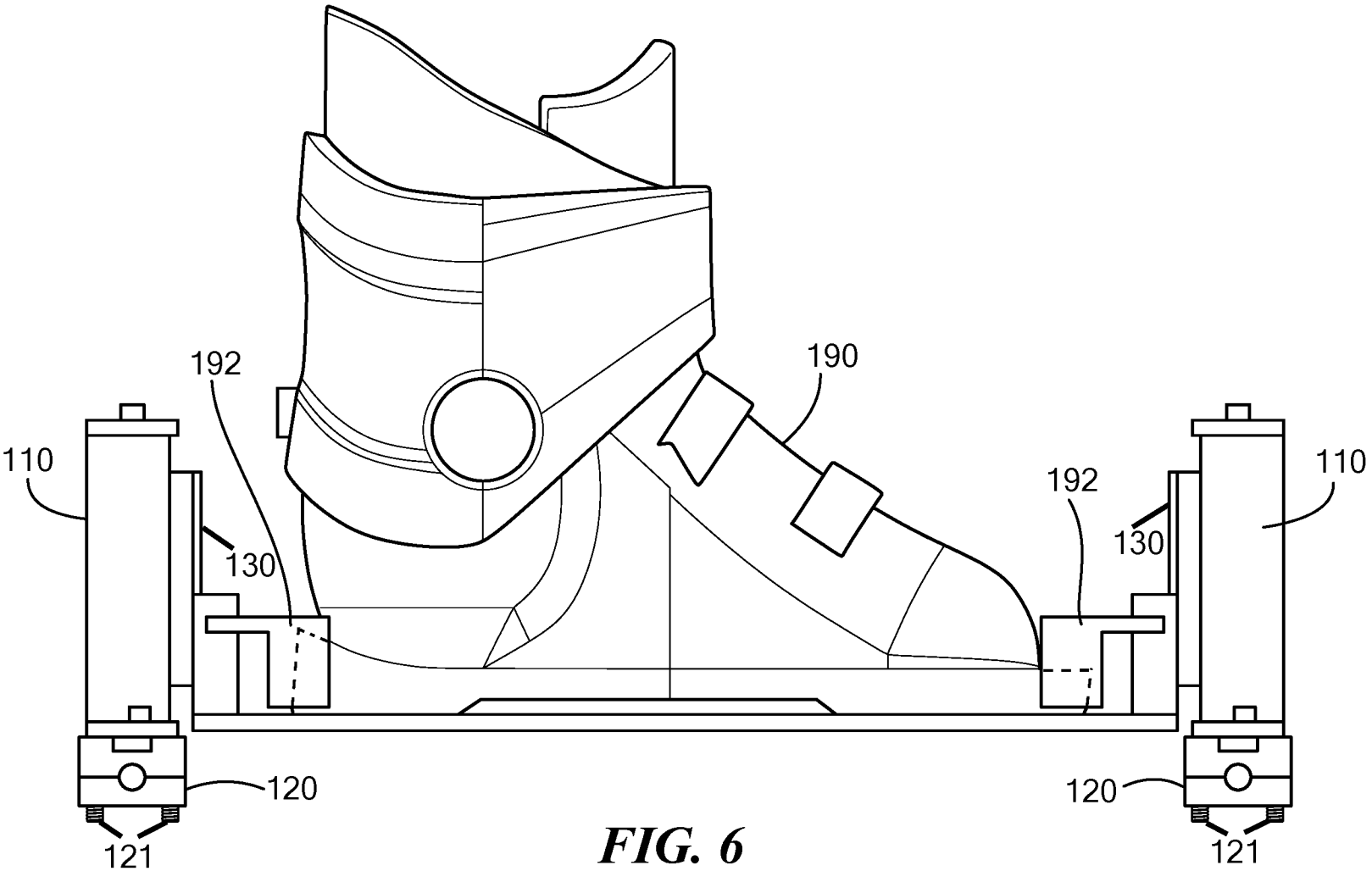
FIG. 6 shows displacement assemblies disposed at heel and toe positions of a boot.

FIG. 6 shows displacement assemblies 110, 120 disposed at heel and toe positions of a boot 190. Referring to FIGS. 1, 2 and 6, the boot interface 130 is adapted to attach the displacement assemblies to the ski boot 190. Force release bindings 192 or attachments define the injury threshold 307 to release the boot when the absorptive displacement distance of the displacement assemblies 110, 120 has attained a maximum travel position.

Figure 7:
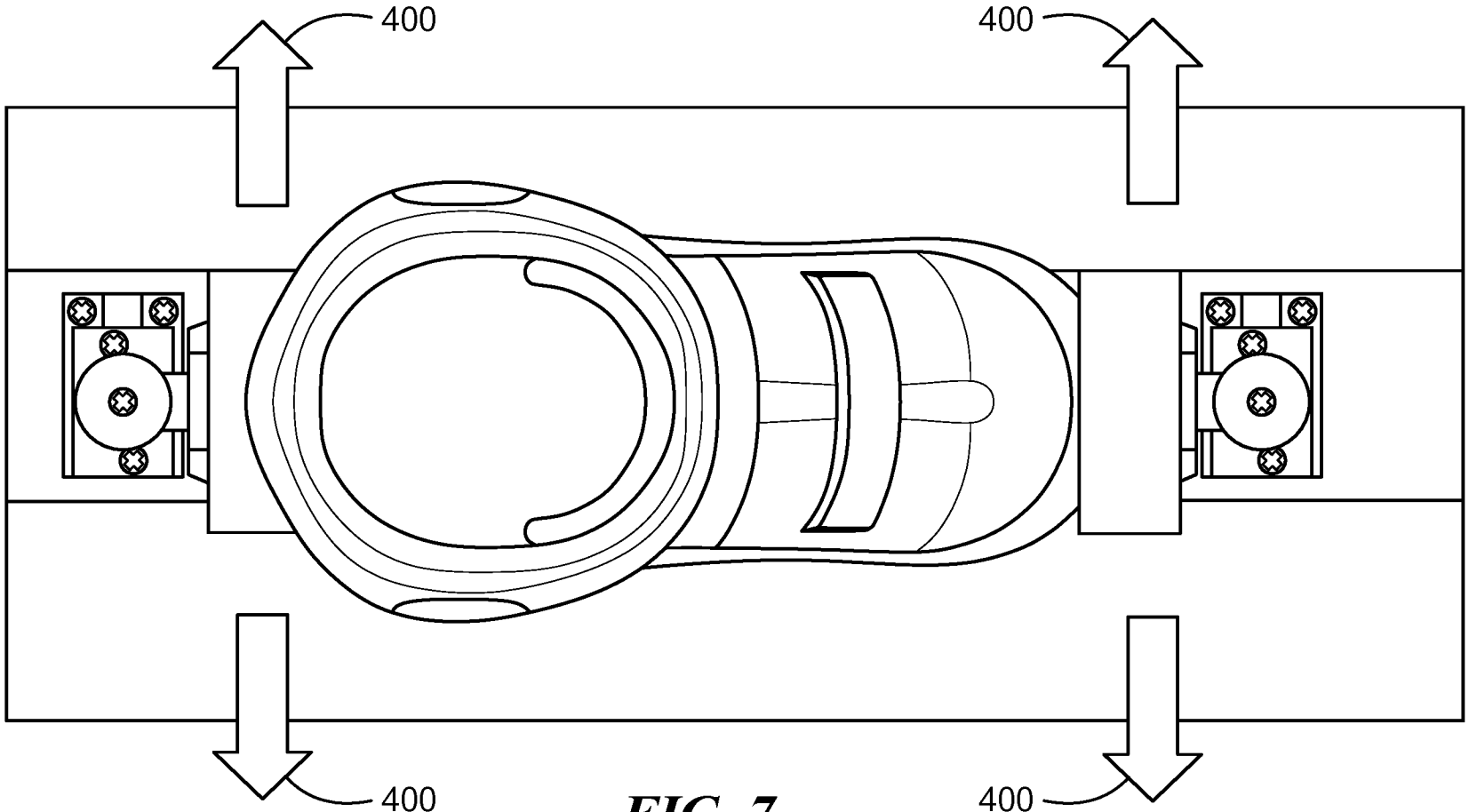
FIG. 7 shows displacement of the boot of FIG. 6 in a lateral direction.
Figure 8:
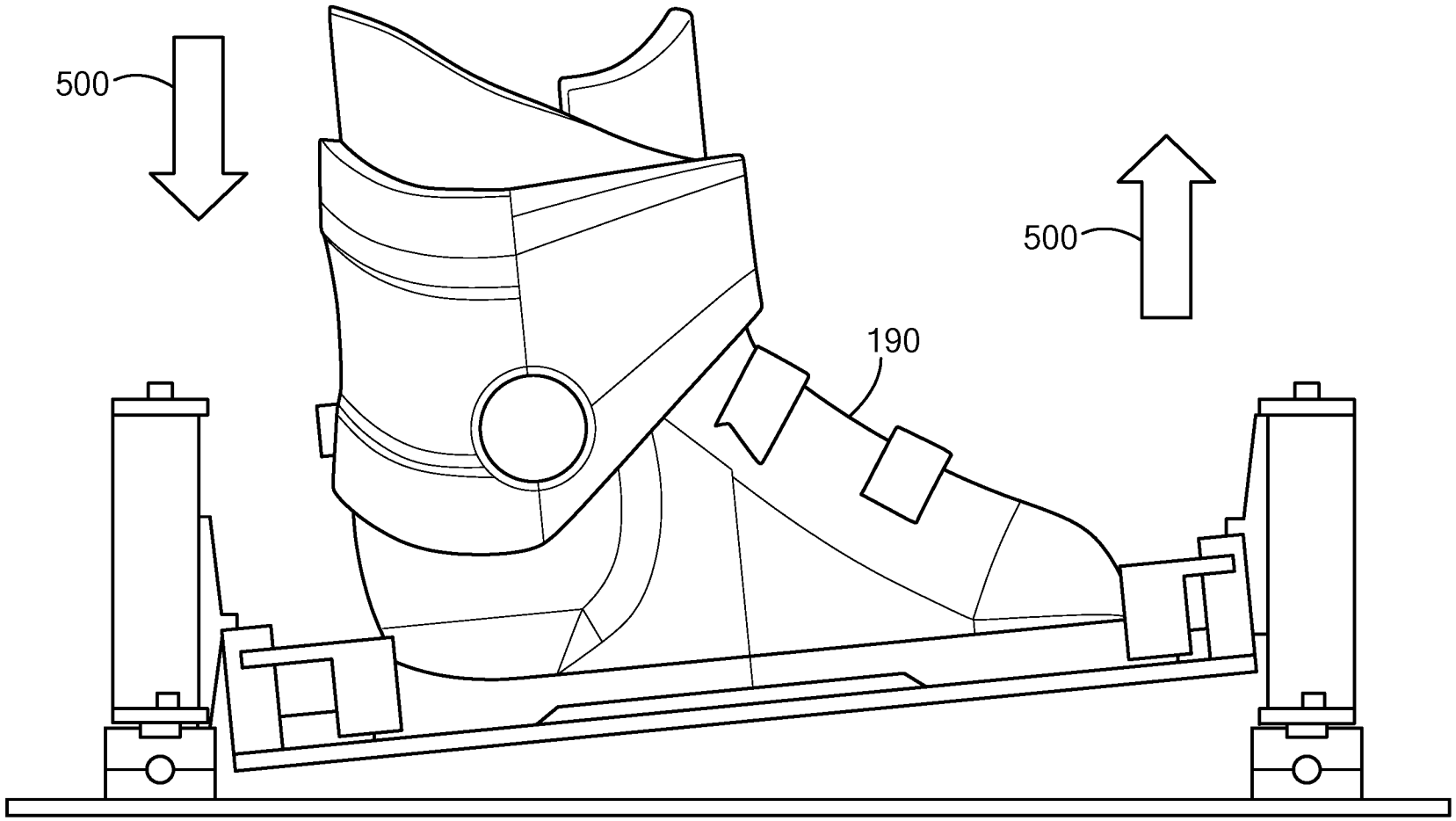
FIG. 8 shows displacement in a boot induced anterior drawer (BIAD) scenario.
Figure 9:
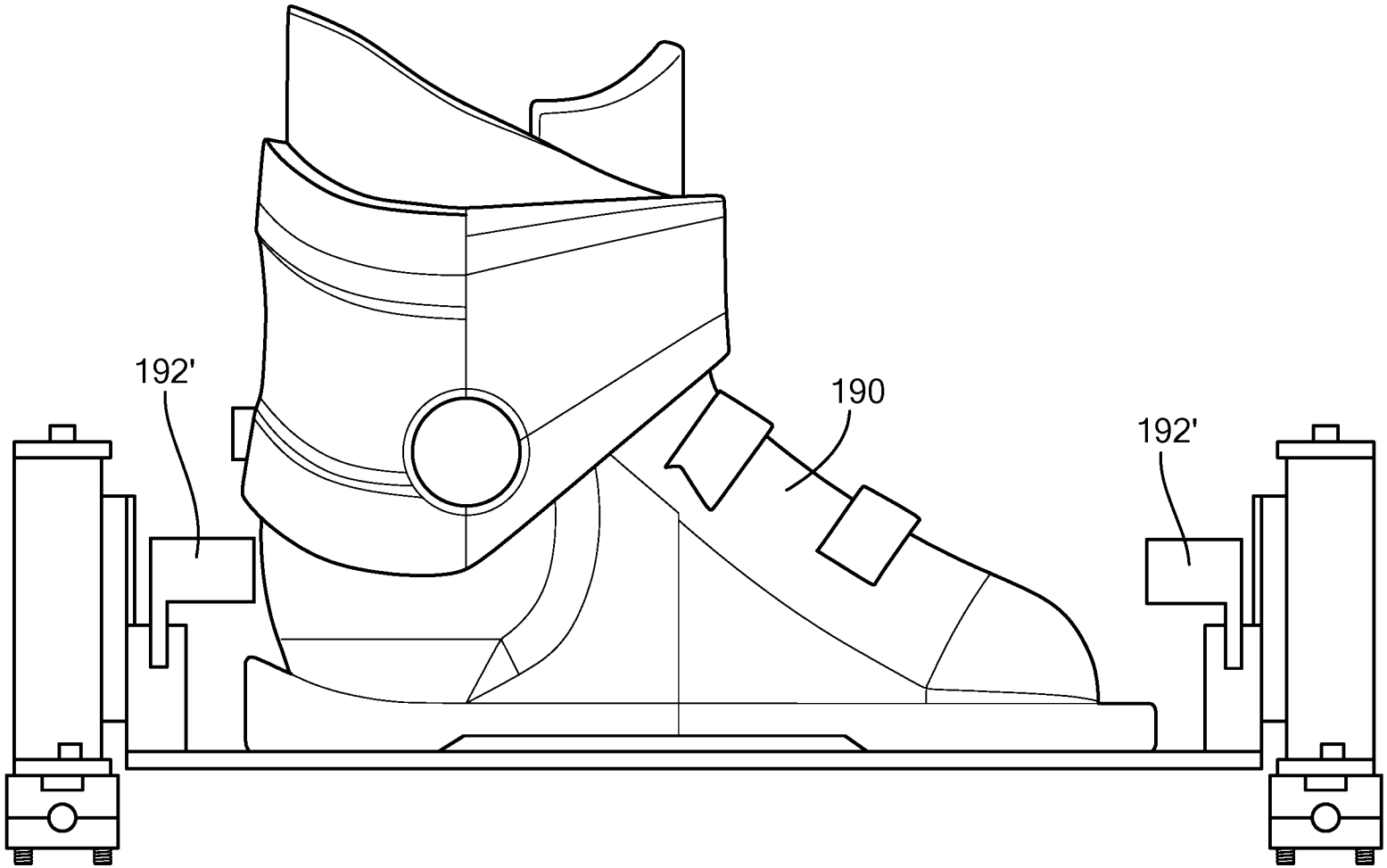
FIG. 9 shows a boot release based on a release threshold.

FIG. 7 shows displacement of the boot of FIG. 6 in a lateral direction, and FIG. 8 shows displacement in a boot induced anterior drawer (BIAD) scenario. Referring to FIGS. 3 and 6-8, the lateral displacement assembly 120 includes threaded members 121 or similar fasteners on an underside that define a ski interface adapted to attach the displacement assemblies to a ski, such that the displacement assemblies are disposed serially between the boot interface and the ski interface and adapted to receive the counter forces exerted from the ski. This allows concurrent absorption of multidimensional (lateral and vertical) forces on the ski boot. For lateral forces 400, or vertical forces 500, the displacement assemblies 110, 120 are adapted to withstand forces below a performance load threshold, such that the force biasing members 150 remain uncompressed. In FIG. 8, upon forces beyond the control threshold 305 but below the injury threshold 307, the displacement assemblies 110, 120 are adapted to displace and recover from counter forces above the performance (control) threshold 305 and below the release threshold 307 indicative of injury, as shown by boot 190 movement and angle in FIG. 8. In FIG. 9, upon forces exceeding the injury threshold 307, the displacement assemblies 110, 120 exhibit maximum displacement as the linkage protrusion 154 or 254 reaches a limit, completely compressing one of the force biasing members 150 and transmitting force through (rather than absorbing it) to the bindings 192' which release, as shown in FIG. 9.

Figure 10:
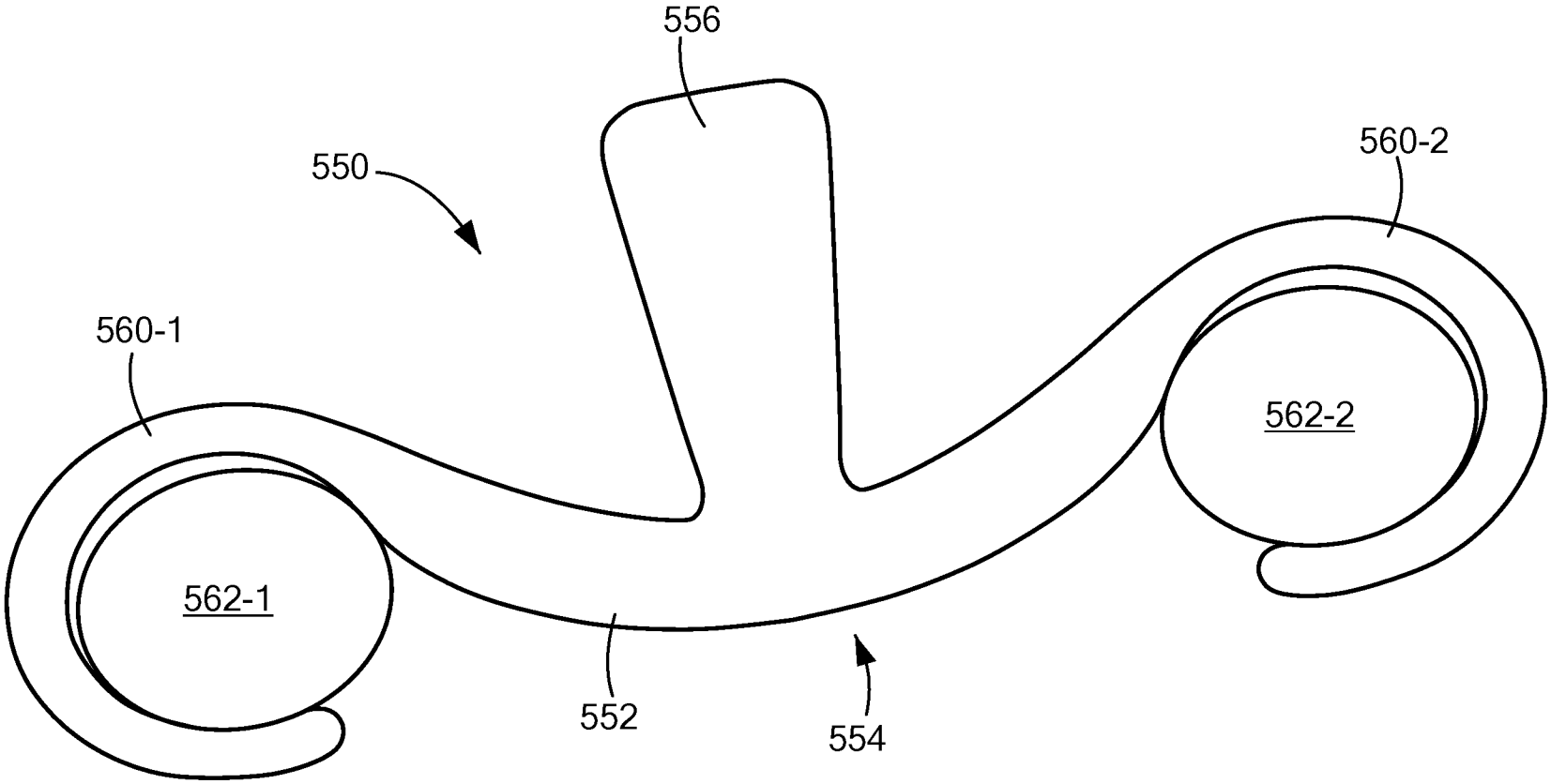
FIG. 10 shows a constant force spring configuration as an alternate force biasing member.

FIG. 10 shows a constant force spring configuration as an alternate force biasing member 150. In FIG. 10, the force biasing member 550 include a transverse beam 552 adapted for biasing against a midpoint 554 on the beam, by forces engaging protrusion 556. The beam has elongated resilient members 560-1, 560-2 extending around annular posts 562-1, 562-2 perpendicular to the received force. The constant force spring configuration allows a more level force as shown in FIG. 3, without a sharp increase or decrease in force at an extreme of travel, as is exhibited in conventional springs.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. A load limiting and absorptive ski binding, comprising:
- a plurality of displacement assemblies including:
  - a vertical displacement assembly adapted to absorb vertical forces, and
  - a lateral displacement assembly adapted to absorb lateral forces
- concurrently with the vertical displacement assembly;
- the displacement assemblies each adapted for a maximum displacement against counter forces;
- a ski interface adapted to attach the displacement assemblies to a ski; and
- a boot interface adapted to attach the displacement assemblies to a threshold-based release binding for engaging a boot;
- each of the vertical displacement assembly and the lateral displacement assembly further comprising:
  - opposed force biasing members for exerting a counterforce against forces transmitted from the ski interface; and
  - a moveable slide and linkage protrusion between the opposed force biasing members, the linkage protrusion adapted to receive the transmitted forces from the ski interface and transfer the received forces to the force biasing members.

2. The device of claim 1 wherein displacement is defined by movement of the boot interface relative to the ski interface from movement in at least one of the vertical displacement assembly and lateral displacement assembly.

3. The device of claim 1 wherein the moveable slide and force biasing members is enclosed in a cavity and a cover for resistance to incursion of contamination.

4. The device of claim 1 wherein the moveable slide includes a rest position defined by an unbiased position between equally displaced force biasing members.

5. The device of claim 1 wherein the displacement assemblies are adapted to absorb forces below a control threshold, the force biasing members remaining incompletely compressed.

6. The device of claim 1 wherein the displacement assemblies are adapted to displace by compressing and decompressing at least one of a plurality of the force biasing members.

7. The device of claim 1 wherein each of the lateral displacement assembly and vertical displacement assembly is adapted for compression of at least one of the force biasing members in response to forces insufficient to result in complete compression of the force biasing members.

8. The device of claim 1 wherein the force biasing members have a predetermined counterforce in response to displacement of a moveable slide and protrusion in a respective displacement assembly.

9. A ski binding device, comprising:

a vertical displacement assembly coupled between a lateral displacement assembly and a boot interface;

the lateral displacement assembly coupled between the vertical displacement assembly and a ski interface for attaching the lateral displacement assembly to a ski;

each of the vertical displacement assembly and the lateral displacement assembly further comprising:

opposed force biasing members for exerting a counterforce against forces transmitted from the ski interface; and a moveable slide and linkage protrusion between the opposed force biasing members, the linkage protrusion adapted to receive the transmitted forces from the ski interface and transfer the received forces to the force biasing members;

the opposed force biasing members disposed in the lateral displacement assembly for exerting counterforce against lateral forces; and the opposed force biasing members disposed in the vertical displacement assembly for exerting counterforce against vertical forces, the boot interface adapted to engage the vertical displacement assembly for receiving the exerted counterforce against the lateral forces and the vertical forces based on ski movement transmitted via the ski interface.

* * * * *